US005803837A

United States Patent [19]

LoFaso, Sr.

[11] Patent Number: 5,803,837

[45] Date of Patent: Sep. 8, 1998

[54] BASKETBALL PRACTICE DEVICE

[75] Inventor: Samuel J. LoFaso, Sr., Sewickley, Pa.

[73] Assignee: LoFaso and LoFaso Incorporated, Sewickley, Pa.

[21] Appl. No.: 882,374

[22] Filed: Jun. 25, 1997

[51] Int. Cl.[6] ..... A63B 69/00

[52] U.S. Cl. ..... 473/433; 473/448

[58] Field of Search ..... 473/431, 432, 473/433, 479, 447, 448, 100, 101

[56] References Cited

U.S. PATENT DOCUMENTS

| | | | |
|---|---|---|---|
| 2,039,794 | 5/1936 | Hayden . | |
| 2,708,576 | 5/1955 | Verkuilen . | |
| 2,918,283 | 12/1959 | Marschalk . | |
| 3,342,486 | 9/1967 | Farley . | |
| 3,365,196 | 1/1968 | Miller . | |
| 4,206,915 | 6/1980 | Woodcock . | |
| 4,213,606 | 7/1980 | Wilson . | |
| 4,226,416 | 10/1980 | Callanan . | |
| 4,896,882 | 1/1990 | Coleman | 473/433 |
| 5,098,090 | 3/1992 | Juhl | 473/433 |
| 5,184,814 | 2/1993 | Manning | 473/433 |
| 5,558,323 | 9/1996 | LoFaso, Sr. . | |

*Primary Examiner*—William H. Grieb
*Attorney, Agent, or Firm*—Carothers & Carothers

[57] ABSTRACT

A basketball practice device wherein an auxiliary target ring or hoop is supported above a standard horizontal basketball hoop or ring in a plane that is disposed at an acute angle from the plane of the supporting ring. A curved basketball guide chute depends downwardly from the supporting ring for guiding a basketball falling through the supporting ring back toward a basketball shooter. This downwardly depending guide chute also serves as a handle mechanism for manipulating the practice device to rotate it on the standard basketball hoop or to remove from or mount it onto the standard basketball hoop.

11 Claims, 3 Drawing Sheets

BASKETBALL PRACTICE DEVICE

BACKGROUND OF THE INVENTION

The present invention relates to a basketball practice device adapted to be mounted independently or on a standard basketball goal or ring.

It is desirable that basketball players develop a high degree of accuracy in throwing the ball from various locations on the basketball floor such that the ball will drop into the basket. This is particularly true with regard to foul shots.

While some players have reasonably good skills in making jump shots and lay-up shots, they can nevertheless have considerable difficulty in making foul shots from the foul line. In shooting such foul shots, its is desirable to learn to make the shots with the proper arc such that the ball trails directly through the basket and does not engage the basket rim or hoop. This is generally referred to as a "swish" shot.

The basket hoop or ring is mounted in a horizontal fashion and projects from a backboard. Of course, when the basket so mounted is viewed from the playing floor by the basketball player, one is not able to visualize the true size of the target or hoop and they are not readily able to judge the arc through which the ball must travel to "swish" through the hoop.

In order to enhance the player's view of the target and help them to better judge the required arc of the ball to be thrown, and to further become more proficient in making foul shots, bank shots and other long shots by educating ones muscles to continuously react in the same manner each time, an auxiliary practice ring as illustrated in U.S. Pat. No. 2,039,794 was developed wherein an auxiliary ring is supported above a basketball basket supporting ring at an acute angle thereto whereby players can throw a ball through the auxiliary ring and the basket supporting ring. The auxiliary ring, not being in a horizontal plane, provides the player with a true picture as to actually how large the hoop or ring diameter is and additionally provides a large visual target for the basketball player, giving him or her an accurate visual arc through which the basketball must travel in order to properly drop through both rings.

My U.S. Pat. No. 5,558,323 discloses another basketball practice device which provides a target ring that is supported above a standard horizontal basketball hoop. An adjustment mechanism is provided for selectively adjusting and maintaining a desired acute angle between the auxiliary target ring and the standard basketball hoop.

A problem encountered with these prior art basketball practice devices is that they cannot be adjusted from the floor and one must utilize scaffolds, ladders or poles to make adjustments. Another problem is that a player must always be positioned under the basket to retrieve the basketball and pass it back to the shooter for continued practice.

It is a principal object of the present invention to eliminate this deficiencies and provide a basketball practice device which will encourage the basketball player to attain ever higher degrees of proficiency.

SUMMARY OF THE INVENTION

The basketball practice device of the present invention is comprised generally of an auxiliary target ring that is supported in general above a basketball supporting ring in a plane disposed at an acute angle from the plane of the supporting ring. A curved basketball guide chute depends downwardly from the supporting ring for guiding a basketball falling through the supporting ring back toward the basketball shooter.

This downwardly depending guide chute not only deflects and guides the ball back to the shooter, but also serves as a handle mechanism which one can easily reach from the basketball floor to adjust the rotation of, or otherwise manipulate, the practice device on the basketball hoop, or to remove or mount the basketball practice device of the present invention on a standard basketball hoop. This eliminates the need or requirement for poles, scaffold or ladders to mount or adjust the basketball practice device of the present invention.

The basketball supporting ring of the basketball of the basketball practice device of the present invention may itself be supported in a horizontal plane to function as a standard basketball ring instead of mounting the same on a standard basketball ring or hoop. In this regard, a wall bracket may be provided for supporting the supporting ring of the basketball practice device in a horizontal plane from a vertical wall.

However, in normal use, the supporting ring of the basketball practice device of the present invention includes a basketball ring mount for aligned support of the supporting ring on a standard basketball ring or hoop.

In addition, it is also desirable that the auxiliary target ring be removably mounted on the basketball supporting ring of the basketball practice device of the present invention. This permits removal of the auxiliary target ring when it is desired to use the device of the present invention as an ordinary or standard basketball hoop which still has the capability of returning the basketball to the shooter when a shot is made.

The supporting ring is adjustably rotatable relative to the standard basketball ring, on which it is mounted, about a vertical axis.

A basketball speed restriction ring is also supported on the guide chute below the basketball supporting ring for receiving a basketball falling through the supporting ring before it contacts the guide chute. This speed restriction ring is large enough to pass a standard basketball, but is smaller in diameter than the support ring or a standard basketball ring. This smaller diameter causes the basketball falling through the restriction ring to engage the restriction ring in one manner or another thereby restricting the travel speed of the basketball being guided down the chute.

Otherwise, without the speed restriction ring, the ball is directed back to the shooter at a speed which is much more rapid than desirable.

BRIEF DESCRIPTION OF THE DRAWINGS

Other objects and advantages will become apparent in the following description and claims. The accompanying drawings show, for the purpose of exemplification and without limiting the invention, certain practical embodiments of the present invention wherein:

DETAILED DESCRIPTION OF THE DRAWINGS

Figure 1:
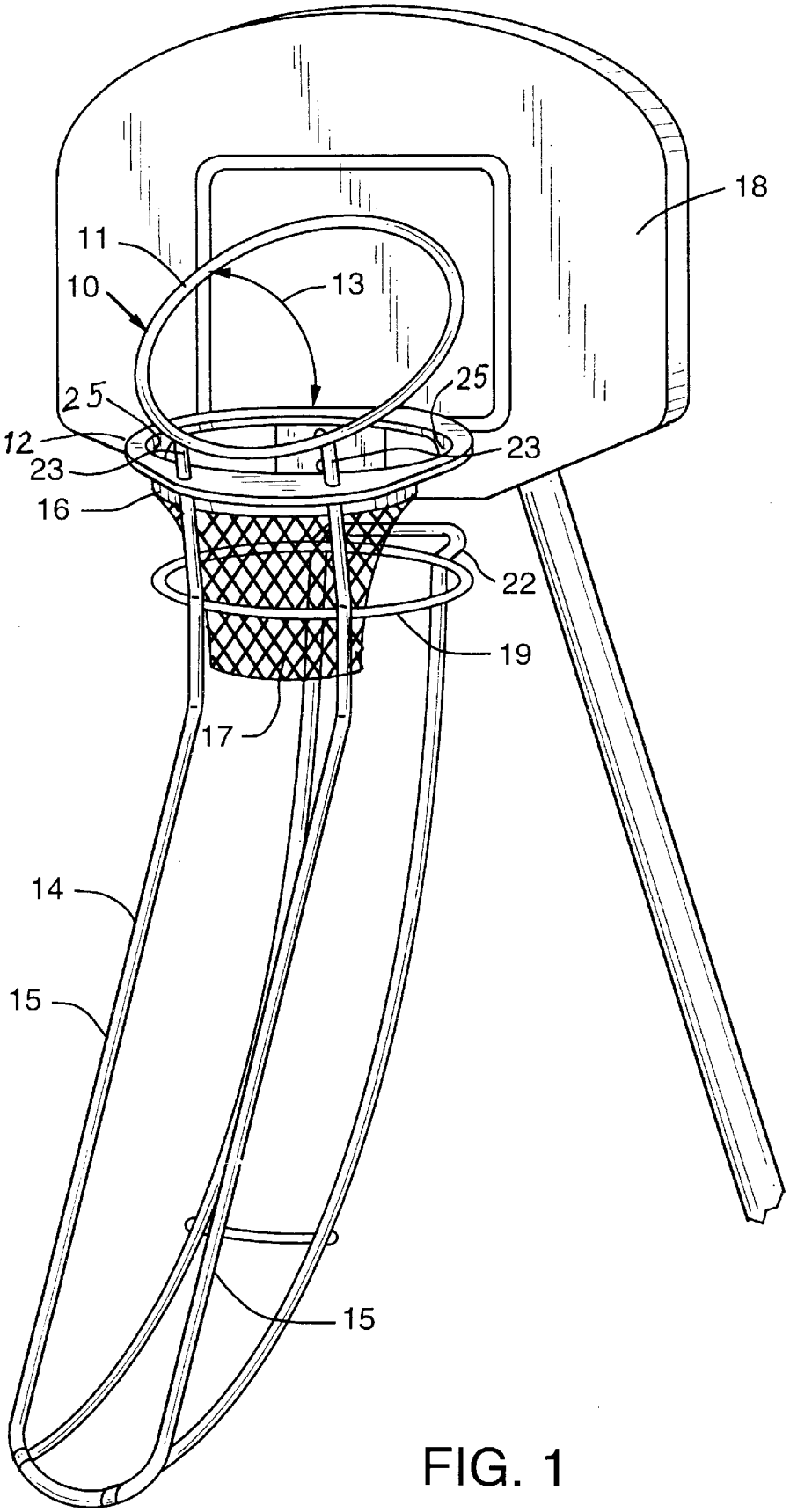
FIG. 1 is a perspective view of the basketball practice device of the present invention as seen from below and to the right.
Figure 2:
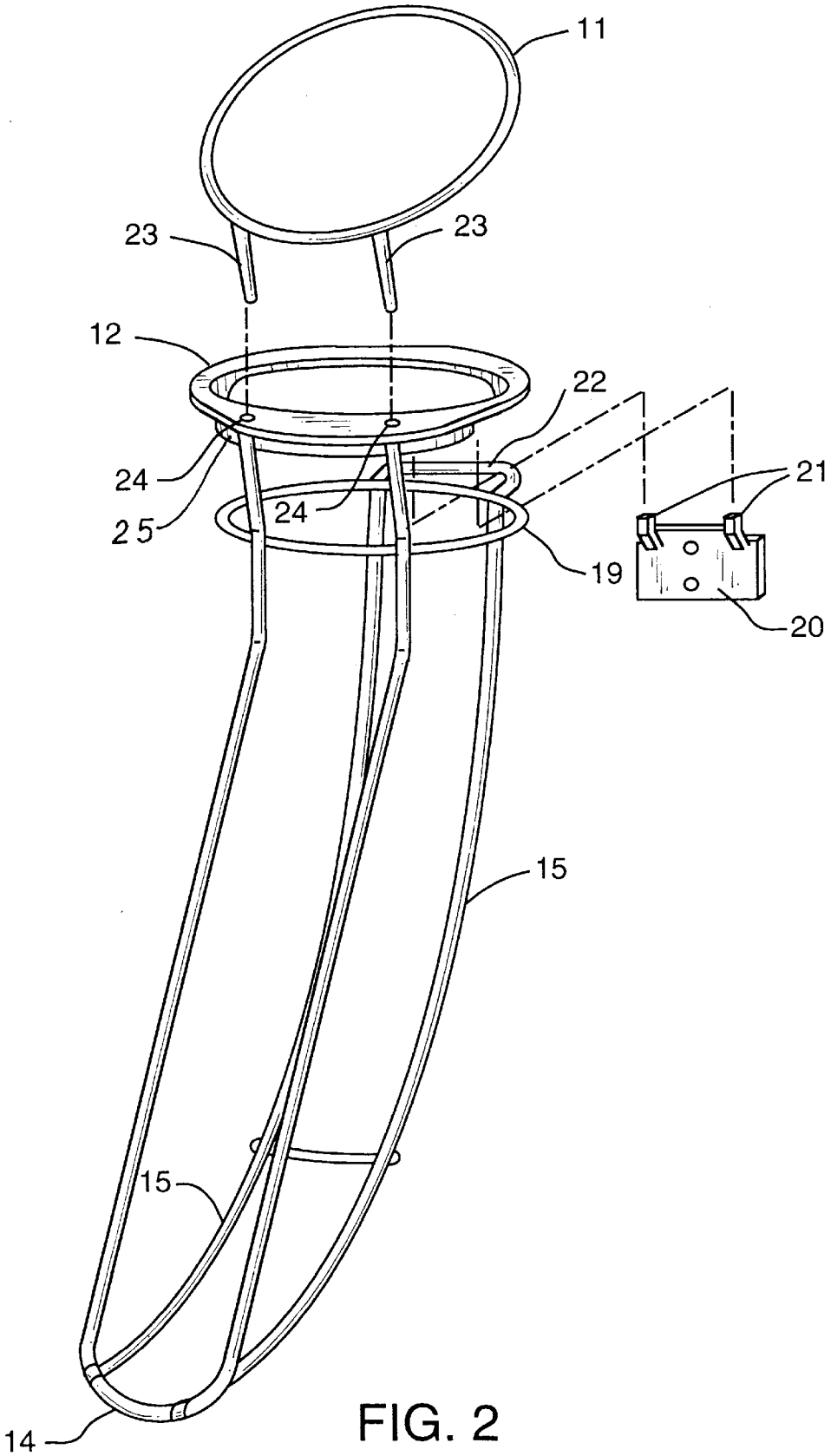
FIG. 2 is an exploded perspective view as seen from above and to the right showing the basketball practice device of the present invention illustrated in FIG. 1 as mounted on a wall bracket, instead of on a standard basketball hoop.
Figure 3:
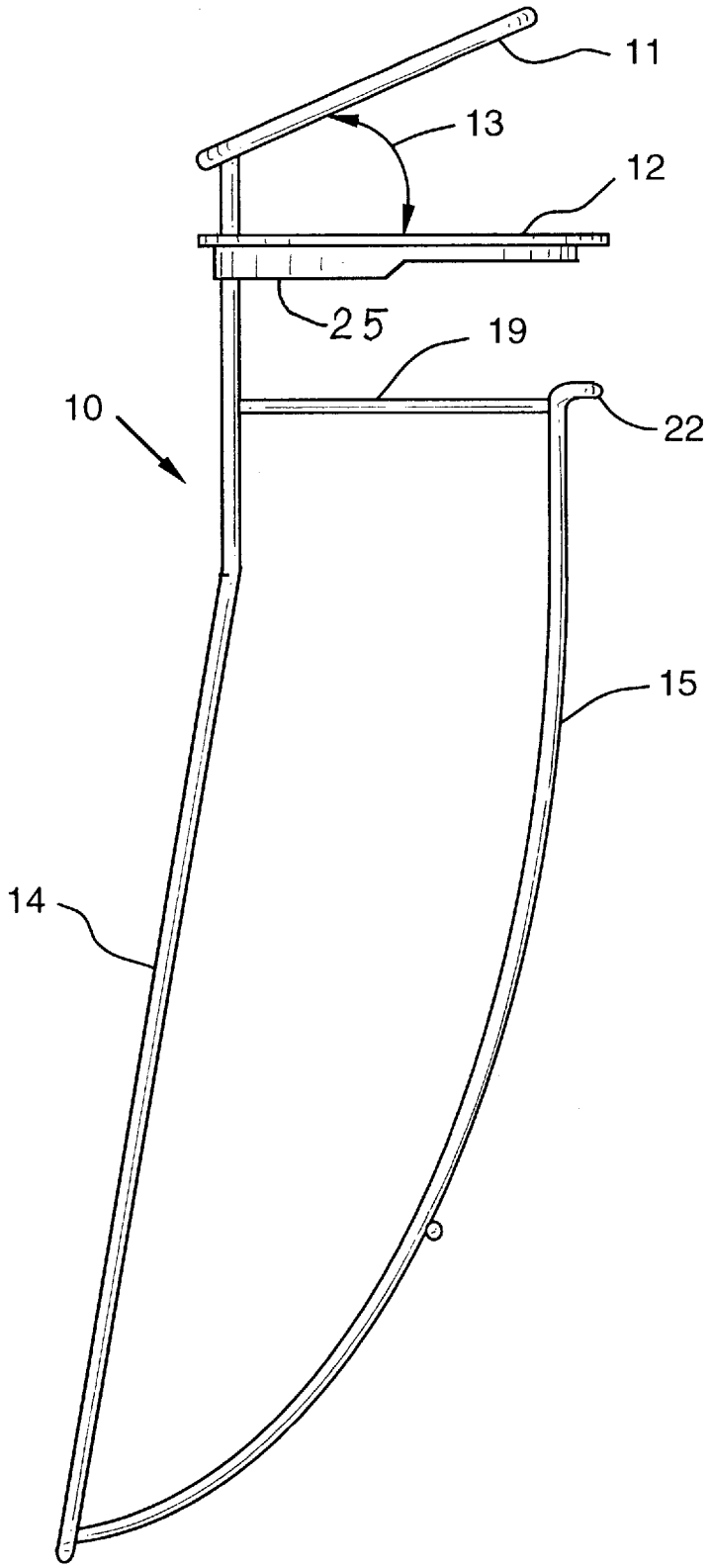
FIG. 3 is a right view in side elevation of the basketball practice device shown in FIG. 2.

Referring to FIGS. 1, 2 and 3, the basketball practice device 10 of the present invention includes a target auxiliary ring 11 supported in general above basketball supporting ring 12 in a plane disposed at an acute angle 13 (generally about 52% to 54%) from the horizontal plane of supporting ring 12.

A curved basketball guide chute 14 having two curved guide legs 15 depends downwardly from supporting ring 12 for guiding a basketball falling through supporting ring 12 back toward a basketball shooter. The upper end of guide chute 14 is provided with a basketball speed restriction ring 19 that is supported on guide chute 14 below basketball supporting ring 12. Speed restriction ring 19 is provided for receiving a basketball falling through supporting ring 12, and/or standard basketball hoop 16, yet the diameter of restriction ring 19 is smaller in diameter than support ring 12 or standard basketball ring 16 for restricting the travel speed of a basketball being guided down chute 14. Otherwise the ball is directed back to the shooter much more rapidly than desired.

Accordingly, when a basketball falls through support ring 12, and also possibly standard basketball ring 16, it will be caused to engage speed restriction ring 19 whereby the basketball is caused to slow its downward fall before it engages chute 14.

Supporting ring 12 is designed for aligned mounting and support on a standard basketball ring 16 that in turn is mounted in standard fashion to basketball backboard 18. Support ring 12 is provided with a downwardly depending lip or skirt 25 which is dimensioned to seat inside ring 16 to retain the basketball practice device in aligned position without fasteners on ring 18.

Supporting ring 12 is adjustably rotatable relative to standard basketball ring or hoop 16 about a vertical axis. In this regard, downwardly depending guide chute 15 may be easily reached by one from the basketball floor to manipulate the practice device 10 as desired.

By grasping chute 15, one can easily rotate support ring 12, and the entire practice device 10 therewith, on supporting standard basketball ring or hoop 16, and in addition the basketball practice device 10 can be easily mounted onto and removed from basketball ring or hoop 16 by easy manipulation from the basketball floor by utilizing the chute 15 as a handle.

When first mounting device 10 onto basket hoop 16, basket net 17 may be deformed. However, it will quickly straighten out when the first basketball falls through hoop 16.

In FIGS. 2 and 3, the supporting ring 12 is not mounted on top of and aligned with a standard basketball ring or hoop 16, as is shown with the embodiment of FIG. 1.

However, it is readily adapted to be mounted onto a vertical wall by means of wall bracket 20 which has upwardly projecting bracket tines 21 that engage and retain bracket 22 provided at the upper end of guide chute 14 on speed restriction ring 19.

In this manner, the basketball practice device 10 of the present invention may be mounted to a wall by mounting bracket 22 on to tines 21 of wall bracket 20 and permitting the outside surfaces of curve guide arms 15 to there below contact the vertical wall. In this manner, the practice device 10 may be supported on a wall surface, instead of on a standard basketball hoop, for regular basketball practice, thereby providing additional basketball practice rings or hoops to accommodate multiple basketball players.

In addition, auxiliary target ring or hoop 11 is removable from supporting ring 12 as indicated in FIG. 2 so that the remaining structure of basketball practice device 10 may be used as a standard basketball hoop with a basketball return chute attached.

Removable target ring or hoop 11 is provided with two spaced downwardly depending tines 23, which are correspondingly received in tubular passages 24 of supporting ring 12 to retain target hoop 11 at the proper angle and relationship relative to support ring 12 when mounted thereto.

By viewing the figure it can be readily observed that one can easily remove basketball practice device 10 from a standard basketball hoop by merely grasping and manipulating the basketball return chute 14 as a handle, and that one can additionally manipulate device 10 on standard basketball ring or hoop 16 and rotate it about a vertical axis thereon again by merely grasping and manipulating basketball return chute 14 as a handle.

I claim:

1. A basketball practice device comprising an auxiliary target ring supported in general above a basketball supporting ring in a plane disposed at an acute angle from the plane of said supporting ring, and a curved basketball guide chute depending downwardly from said supporting ring for guiding a basketball falling through said supporting ring back toward a basketball shooter, said supporting ring including a basketball ring mount for aligned support of said supporting ring on a standard basketball ring, said mount comprised of a skirt depending downwardly from said supporting ring and dimensioned to seat inside a standard basketball ring for retaining said basketball practice device in aligned position on a standard basketball ring.

2. The basketball practice device of claim 1, including a support for supporting said basketball supporting ring in a horizontal plane to function as a standard basketball ring.

3. The basketball practice device of claim 2, said support including a standard basketball ring whereby said supporting ring is supported thereon.

4. The basketball practice device of claim 3, wherein said supporting ring is adjustably rotatable relative to said standard basketball ring about a vertical axis.

5. The basketball practice device of claim 2, including a wall bracket for supporting said supporting ring.

6. The basketball practice device of claim 1, said auxiliary target ring removably mounted on said basketball supporting ring with two tines depending downwardly from said target ring and received respectively in corresponding tubular passages in said supporting ring for supporting said target ring above said supporting ring.

7. The basketball practice device of claim 1, including a basketball speed restriction ring supported on said guide chute below said basketball supporting ring for receiving a basketball falling through said supporting ring, said speed restriction ring being large enough to pass a standard basketball, but smaller in diameter than said support ring for restricting the travel speed of a basketball being guided down said chute.

8. A basketball practice device comprising an auxiliary target ring supported in general above a basketball supporting ring in a plane disposed at an acute angle from the plane of said supporting ring, and a curved basketball guide chute depending downwardly from said supporting ring for guiding a basketball falling through said supporting ring back toward a basketball shooter, said auxiliary target ring removably mounted on said basketball supporting ring.

9. The basketball practice device of claim 8 wherein said auxiliary target ring is removably mounted on said basketball supporting ring with two tines depending downwardly from said target ring and received respectively in corresponding tubular passages in said supporting ring for supporting said target ring above said supporting ring.

10. The basketball practice device of claim 8, said supporting ring including a basketball ring mount for aligned support of said supporting ring on a standard basketball ring, said mount comprised of a skirt depending downwardly from said supporting ring and dimensioned to seat inside a standard basketball ring for retaining said basketball practice device in aligned position on a standard basketball ring.

11. The basketball practice device of claim 8, including a basketball speed restriction ring supported on said guide chute below said basketball supporting ring for receiving a basketball falling through said supporting ring, said speed restriction ring being large enough to pass a standard basketball, but smaller in diameter than said supporting ring for restricting the travel speed of a basketball being guided down said chute.

* * * * *